US007007830B2

(12) United States Patent
Parve et al.

(10) Patent No.: US 7,007,830 B2
(45) Date of Patent: Mar. 7, 2006

(54) CLOSURE FOR A CONTAINER

(75) Inventors: Terrence M. Parve, Menomonee Falls, WI (US); William C. Vogel, Milwaukee, WI (US)

(73) Assignee: Gateway Plastics, Inc., Mequon, WI (US)

( * ) Notice: Subject to any disclaimer, the term of this patent is extended or adjusted under 35 U.S.C. 154(b) by 5 days.

(21) Appl. No.: 10/751,709

(22) Filed: Jan. 5, 2004

(65) Prior Publication Data

US 2004/0134942 A1 Jul. 15, 2004

Related U.S. Application Data

(63) Continuation of application No. 10/020,581, filed on Dec. 14, 2001, now Pat. No. 6,691,901.

(51) Int. Cl.
*B65D 47/00* (2006.01)

(52) U.S. Cl. ..... 222/556; 222/480; 222/565; 220/254.2; 220/254.3; 215/245

(58) Field of Classification Search ..... 222/556, 222/565, 530, 536, 480, 498, 153.14; 220/254.2, 220/254.3, 835; 215/237, 245
See application file for complete search history.

(56) References Cited

U.S. PATENT DOCUMENTS 3,140,019 A * 7/1964 Barr ..... 222/480
3,262,606 A * 7/1966 Waterman ..... 222/480
3,499,588 A * 3/1970 Trumbull et al. ..... 222/556
3,563,426 A * 2/1971 Bartilson ..... 222/556
3,675,812 A * 7/1972 Foster ..... 220/835
4,369,901 A * 1/1983 Hidding ..... 222/480
4,545,508 A * 10/1985 Cribb et al. ..... 222/153.06
4,936,494 A * 6/1990 Weidman ..... 222/480
5,048,730 A * 9/1991 Forsyth et al. ..... 222/482
5,203,467 A * 4/1993 Tucker ..... 220/254.3
5,219,100 A * 6/1993 Beck et al. ..... 222/480
5,330,082 A * 7/1994 Forsyth ..... 222/480
5,499,736 A * 3/1996 Kohl ..... 220/254.5
5,509,582 A * 4/1996 Robbins, III ..... 222/158
5,601,213 A * 2/1997 Daniello ..... 222/456
6,164,503 A * 12/2000 Forsyth et al. ..... 222/556
6,250,517 B1 * 6/2001 Samz et al. ..... 222/565

(Continued)

OTHER PUBLICATIONS

Cap of a type understood to be commercially available from Resibel N.V. in or about 1996 and made available/obtained during discovery in Gateway Plastics, Inc. v. Weatherchem Corp., Case No. 02-C-0870 (E.D. Wis.) (twelve photographs, two sheets). Admitted Prior Art.

(Continued)

*Primary Examiner*—Frederick Nicolas
(74) *Attorney, Agent, or Firm*—Foley & Lardner LLP

(57) ABSTRACT

A closure for a container includes a base with at least one opening for dispensing a material from the container and a cover coupled atop the base. The cover includes at least one flap that is movable between an open position for dispensing the material and a closed position for covering the opening. At least one projection extends from the flap to releasably retain the flap in the closed position. A tab extends from the projection. A guide surface is provided on the tab and is configured to contact an edge of the opening when the flap is moved toward the closed position and is configured to create a wedging interaction with the edge of the opening when the flap is moved further toward the closed position. The flap is retained in the closed position by the wedging interaction of the tab and the edge.

58 Claims, 8 Drawing Sheets

U.S. PATENT DOCUMENTS

| | | | | |
|---|---|---|---|---|
| 6,308,870 | B1 * | 10/2001 | Samz et al. | 222/480 |
| RE37,634 | E * | 4/2002 | Hickman et al. | 222/480 |
| 6,460,718 | B1 * | 10/2002 | Vogel | 220/254.2 |
| 6,464,113 | B1 * | 10/2002 | Vogel | 222/480 |
| 6,510,971 | B1 * | 1/2003 | Martin | 222/556 |
| 6,691,901 | B1 * | 2/2004 | Parve et al. | 222/556 |

OTHER PUBLICATIONS

Decision and Order, Gateway Plastics, Inc.V. Weatherchem Corp., Case No. 02-C-0870 (E.D. Wis.), issued Jul. 6, 2005 (35 sheets).

* cited by examiner

CLOSURE FOR A CONTAINER

CROSS REFERENCE TO RELATED APPLICATIONS

The present application is a continuation of U.S. Pat. application Ser. No. 10/020,581 titled "Closure for a Container" filed on Dec. 14. 2001 now U.S. Pat. No. 6,691,901 (which is incorporated by reference in its entirety). The present Application claims the benefit of priority, as available under 35 U.S.C. § 120, to U.S. patent application Ser. No. 10/020,581 titled "Closure for a Container" filed on Dec. 14, 2001, now U.S. Pat. No. 6,691,901 (which is incorporated by reference in its entirety).

The following patents are hereby incorporated by reference: U.S. Pat. No. 6,308,870 titled "Apparatus for Covering a Container" issued Oct. 30, 2001; U.S. Pat. No. 6,250,517 titled "Integrally-Formed Container" issued Jun. 26, 2001; and U.S. Pat. No. 5,971,231 titled "Integrally Formed Container" issued Oct. 26, 1999.

FIELD

The present invention relates to a closure for a container for storing and dispensing particulate matter. The present invention more specifically relates to a closure for hand-held plastic containers with a cover having a plurality of flaps for enclosing, respectively, a plurality of openings in the cover. More specifically, it relates to a closure having improved retention features for maintaining the flaps in a closed position.

BACKGROUND

It is generally known to provide hand-held plastic containers for storing and dispensing particulate matter, particularly foodstuffs or seasonings such as those displayed and sold in supermarkets. Such known containers typically have several openings, particularly a plurality of shaker openings on one side of the container and a single spooning opening on an opposite side of the closure. The known closures generally include a hinged flap for the shaker and for the spooning openings configured to close or seal these openings when the container is not in use.

Such known closures typically include a latching device on the flaps or on the closure body for maintaining the flaps in a closed position when dispensing of the container contents is not required. Such latching devices may include projections or downwardly extending skirts extending from an underside of the flap and configured to engage the opening in an interference-type fit to retain the flap in a closed position. While, such known latching devices may be generally sufficient to maintain the flaps closed under static conditions, these latching devices frequently provide insufficient retention force to maintain the flaps in a closed position during dynamic installation conditions. During installation of the closure on the container by automated equipment, the closure may typically be pressed-on over a circumferential rib, or the closure may be spun-on and tightened to the container via a threaded interface. The torque typically applied to the closure often results in sufficient distortion of the closure body to cause the flap latches to release, allowing the flaps to open on the assembly line. Such release of the flaps during the automated closure process results in the additional time and expense required to manually re-close the closure flaps prior to shipment of the containers.

Accordingly, it would be advantageous to provide a container closure having a more robust design that is more capable of maintaining the flaps in a closed position during automated assembly processes. It would also be advantageous to provide a container closure flap latching device that did not require substantial additional force by a user to open the flaps. It would be further advantageous to provide closure flaps that are biased toward a closed position. It would be further advantageous to provide a container closure flap latching device that does not add substantial complexity or additional forming operations to the closure molding and manufacturing process.

Accordingly, it would be advantageous to provide a closure of the type disclosed in the present application that includes any one or more of these or other advantageous features.

SUMMARY

The present invention relates to an integrally-formed cover for a container having a cylindrical portion, a top portion having a shaker opening, a spooning opening, a shaker flap and a spooning flap. The shaker flap has an outer edge with a downwardly extending skirt, is coupled to the top portion, and is configured for selective movement between an open position in which the shaker opening is opened and a closed position in which the shaker opening is covered by the shaker flap. The spooning flap has an outer edge with a downwardly extending skirt, is coupled to the top portion, and is configured for selective movement between an open position in which the spooning opening is opened and a closed position in which the spooning opening is covered by the spooning flap. At least one projection extends from the shaker flap to releasably retain the shaker flap in the closed position. The projection extending from the shaker flap includes a tab. A guide is provided with the tab so that movement of the shaker flap from the open position to the closed position initially brings the guide into wedging interaction with the inner edge of the shaker opening, and further movement of the shaker flap brings the tab into wedging interaction with the inner edge of the shaker opening. The shaker flap is retained in the closed position by the wedging interaction of the tab against the inner edge of the shaker opening.

The present invention also relates to a closure for a container having a base with at least one opening for dispensing a material from the container and a cover coupled atop the base. The cover includes at least one flap that is movable between an open position for dispensing the material and a closed position for covering the opening. At least one projection extends from the flap to releasably retain the flap in the closed position. A tab extends from the projection. A guide surface is provided on the tab and is configured to contact an edge of the opening when the flap is moved toward the closed position and is configured to create a wedging interaction with the edge of the opening when the flap is moved further toward the closed position. The flap is retained in the closed position by the wedging interaction of the tab and the edge.

The present invention also relates to a closure for a container having a base and a top portion. The base includes at least one opening for dispensing a material from the container. The top portion is coupled to the base and includes at least one flap movable between an open position for dispensing the material and a closed position for covering the opening. A first projection extends from the flap to retain the flap in the closed position. A second projection extends from the first projection. A guide surface is provided on the second projection to contact a portion of the base adjacent the opening when the flap is moved toward the closed position. The guide surface creates a wedging interaction with the portion of the base adjacent the opening when the flap is moved further toward the closed position. The flap is retained in the closed position by the wedging interaction of at least one of the first projection and the second projection with the portion of the base adjacent the opening.

The present invention further relates to a closure for a container having a base with at least one opening for dispensing a material from the container and a top portion coupled to the base having at least one flap movable about a hinge between an open position for dispensing the material and a closed position for covering the opening. A first elongate recess and a second elongate recess are formed in the top portion. A first projection extends from a first side of the flap and a second projection extends from a second side of the flap. The first projection is configured to fit at least partially within the first elongate recess and the second projection is configured to fit at least partially within the second elongate recess when the flap is in the closed position.

DETAILED DESCRIPTION

Figure 1A:
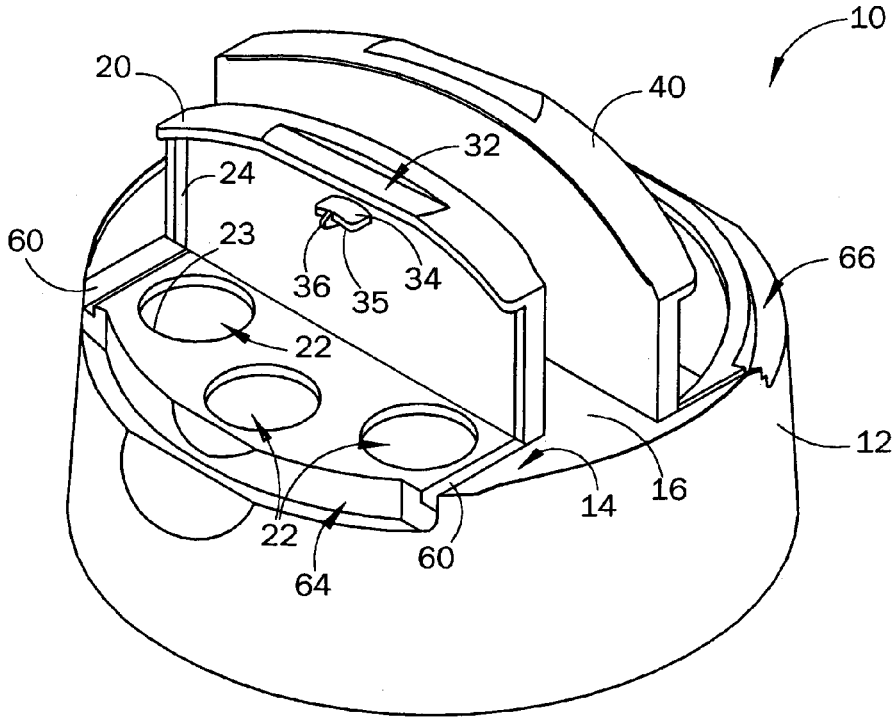
FIG. 1A is a perspective view of a shaker side of a closure for a container according to a preferred embodiment.
Figure 1B:
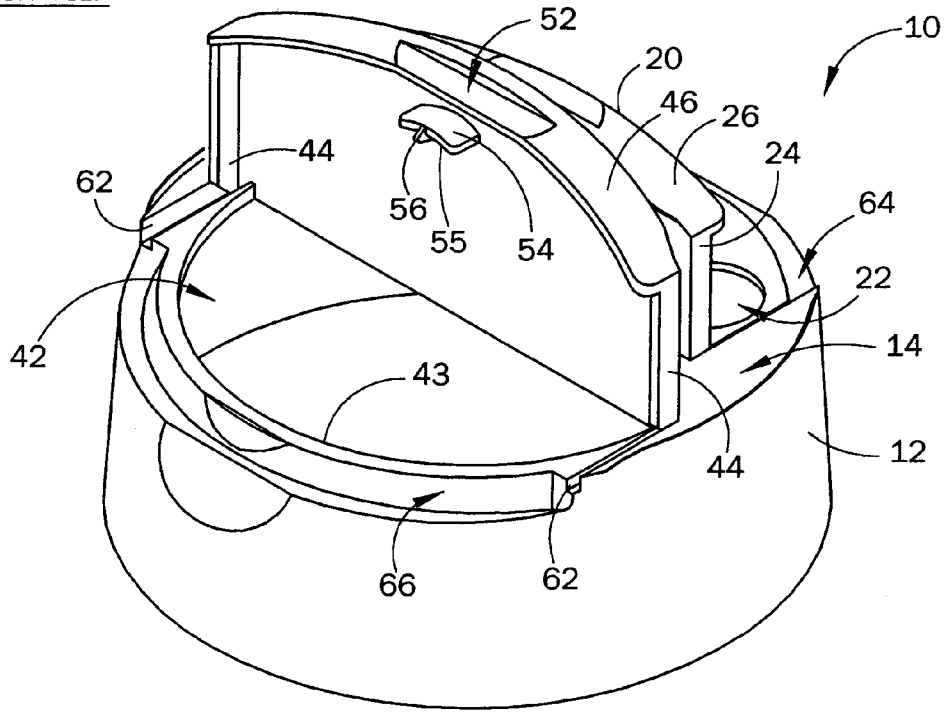
FIG. 1B is a perspective view of a spooning side of a closure for a container according to a preferred embodiment.

Referring to FIGS. 1A and 1B, a closure 10 for a container (not shown) is provided according to a preferred embodiment. Closure 10 includes a shaker flap 20, which covers (when closed) shaker openings 22 located in a top portion 14 of the closure 10. Closure 10 also includes a spooning flap 40 that similarly covers a larger spooning opening 42 located generally opposite from shaker openings 22 on top portion 14. Spooning flap 40 and shaker flap 20 are separated on top portion 14 by a web 16. Closure 10 is preferably adapted for use with a container having a cylindrical shape of the type used for dispensing powdered or granulated material and having an opening diameter in the range of twenty (20) through one-hundred forty (140) millimeters. However, in alternative embodiments, the closure may have any shape suitable for use with other types or sizes of containers and materials to be dispensed.

Figure 4A:
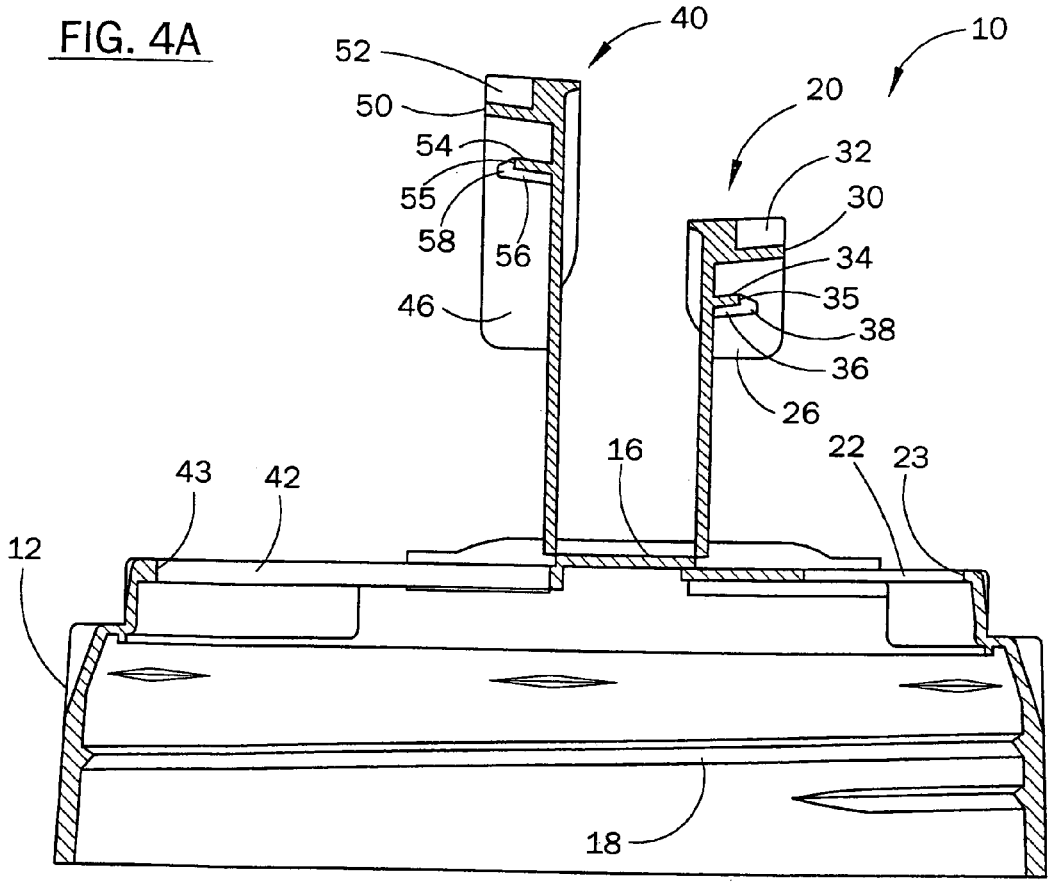
FIG. 4A is a cross sectional view along line 4A—4A of FIG. 3A of a closure for a container with a spooning flap and a shaker flap in an open position according to a preferred embodiment.

Closure 10 is in the form of a substantially cylindrical portion 12 with top portion 14 coupled to, and generally enclosing, an upper end of cylindrical portion 12. Alternatively, cylindrical portion 12 may be frustoconical in shape. Top portion 14 is preferably formed having a concave surface with the lowest portion located in a central region of top portion 14 (as shown schematically in FIG. 2C), however the top portion 14 may be substantially flat in alternative embodiments. Referring to FIG. 4A, threads 18 are provided on the inner surface of cylindrical portion 12 for coupling cylindrical portion 12 to the outside of the top of a dispensing receptacle or container having conventional mating threads (not shown). Alternatively, cylindrical portion 12 may be equipped with an inner detent or a raised ring to allow it to be "snap" connected to a container or receptacle.

Referring to FIG. 1A, closure 10 includes elongate recesses 60 in which a wall portion (shown schematically as shaker side skirts 24) on either side of shaker flap 20 will fit when shaker flap 20 is in a closed position. Closure 10 also includes similar elongate recesses 62 in which a wall portion (shown schematically as spooning side skirts 44) on either side of spooning flap 40 will fit when spooning flap 40 is in the closed position. The fit of the side skirts in the elongated recesses provides a substantially continuous upper surface on top portion 14, upon which a corresponding bottom portion of a similar container can be stacked (not shown).

Figure 2A:
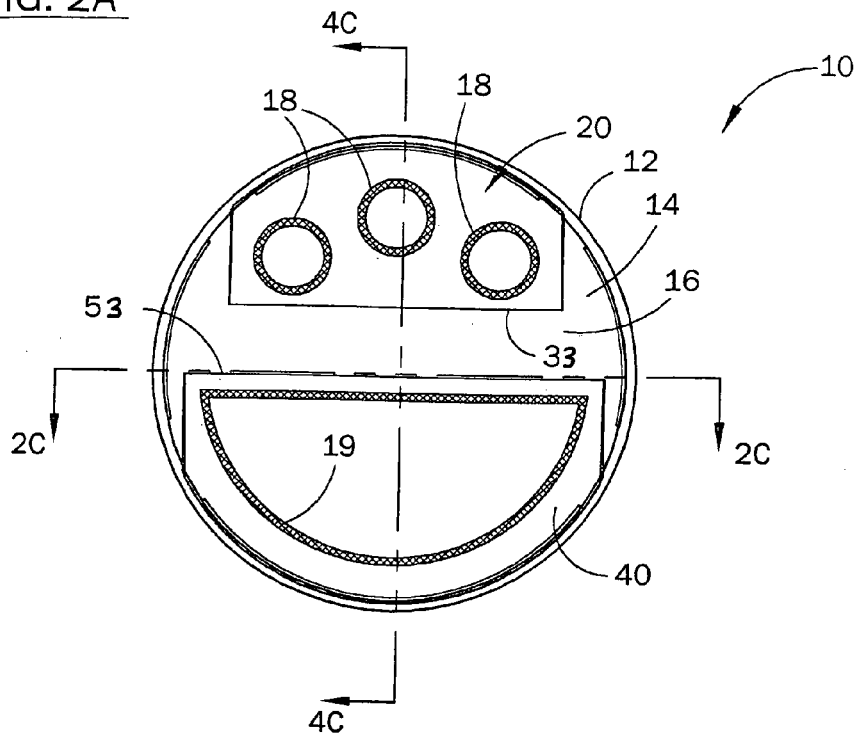
FIG. 2A is a top view of a closure for a container according to a preferred embodiment.
Figure 2B:
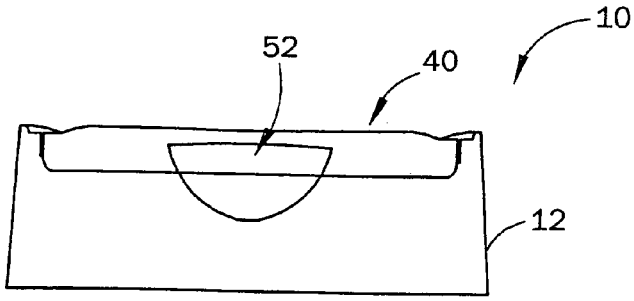
FIG. 2B is a front view of a closure for a container according to a preferred embodiment.
Figure 3A:
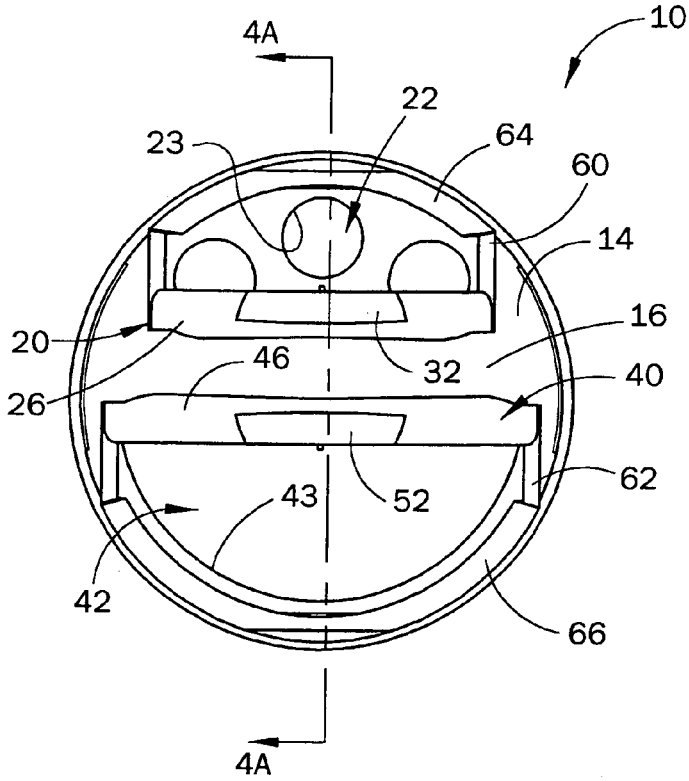
FIG. 3A is a top view of a closure for a container having a shaker flap and a spooning flap in an open position according to a preferred embodiment.
Figure 5A:
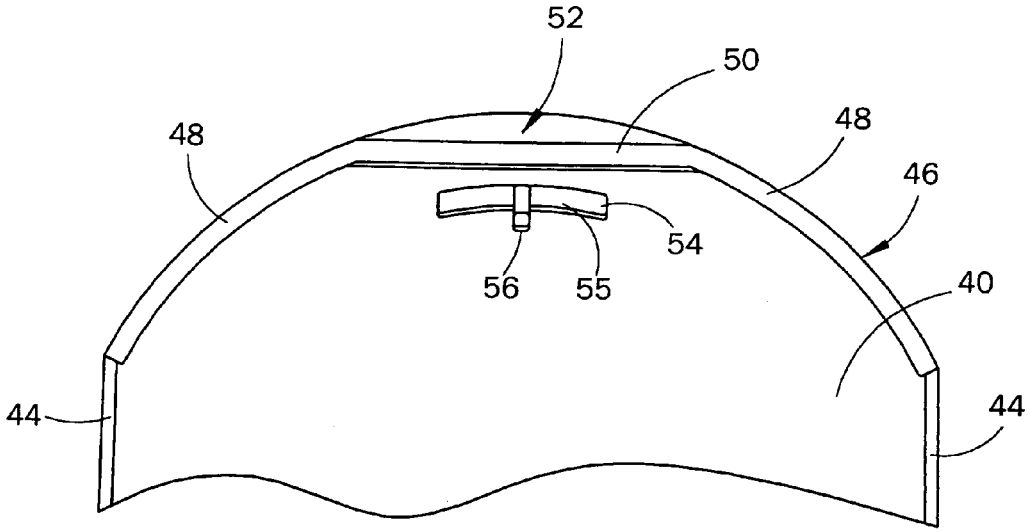
FIG. 5A is an elevation view of a spooning flap in an open position for a closure for a container according to a preferred embodiment.
Figure 5B:
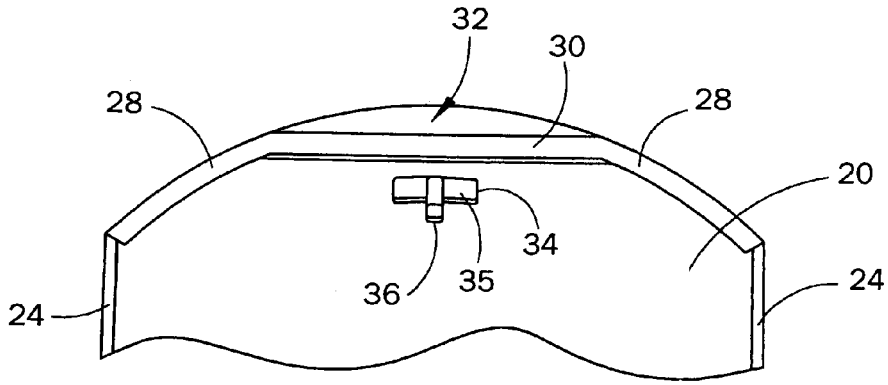
FIG. 5B is an elevation view of a shaker flap in an open position for a closure for a container according to a preferred embodiment.

Referring further to FIGS. 1A, 2B and 3A, shaker flap 20 includes a projection (shown schematically as a downwardly extending front skirt 26) depending from a lower surface of spooning flap 20 that includes an arcuate portion 28 and a substantially straight portion 30 (shown schematically in FIG. 5B). Front skirt 26 extends from shaker flap 20 near an outer edge of shaker flap 20 to define an outer substantially vertical surface of closure 10 when shaker flap 20 is in a closed position. Front skirt 26 has an indentation 32 at a central outer portion of skirt 26 at straight portion 30, which may facilitate opening of the flap by a user. Front skirt 26 preferably extends around closure 10 for an angle of between approximately sixty (60) and one-hundred twenty (120) degrees. Therefore, front skirt 26 forms between sixty (60) and one-hundred twenty (120) degrees of the circumference of the upper part of closure 10. Front skirt 26 is generally arcuate (rather than uniformly straight) and may be less likely to be bent over when the flap is grasped and opened, and further distributes the grasping load more evenly around the outer edge of shaker flap 20. Accordingly, shaker flap 20 may be made using less plastic when manufactured. Shaker flap 20 is coupled to top portion 14 by a flexible and integrally formed hinge 33 defined by a groove preferably extending along a straight line for substantially the entire length of shaker flap 20. Spooning flap 40 is coupled to top portion 14 by a flexible and integrally formed hinge 53 preferably extending along a straight line for substantially the entire length of spooning flap 40. Hinges 33 and 53 are disposed adjacent to web 16 of top portion 14.

Figure 2C:
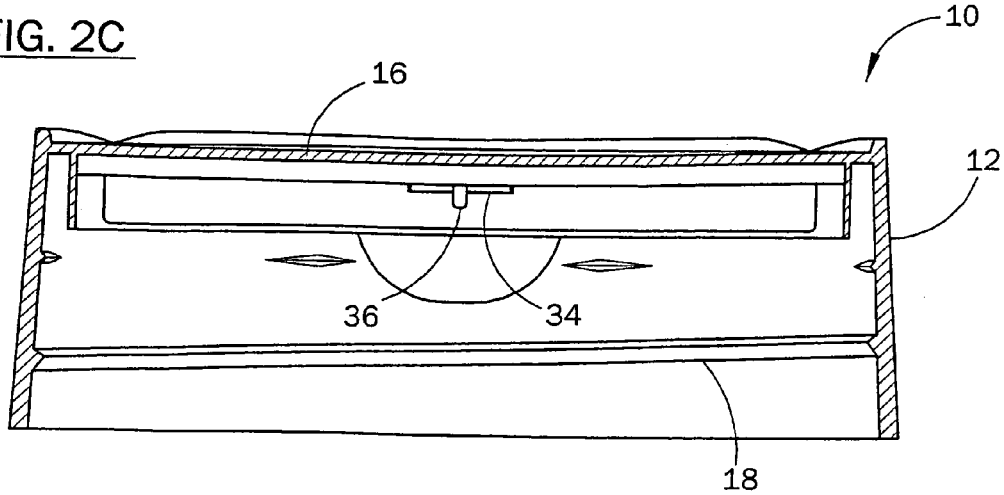
FIG. 2C is a cross sectional view of the closure for a container of FIG. 2A according to a preferred embodiment.

Referring to FIG. 2C, the concave shape of top portion 14 provides a slight inward bow in web 16 and hinges 33 and 53 have an inwardly arcuate or bowed profile according to a preferred embodiment. The arcuate profile of web 16 and hinges 33 and 53 provides a biasing force tending to close shaker flap 20 and spooning flap 40. As shaker flap 20 and spooning flap 40 are moved to an open position, the straight edge of flaps 20 and 40 along hinges 33 and 53 tends to flex the bowed web 16 of concave top portion 14 into a flatter profile. The biasing force created by top portion 14 and web 16 in the flexed condition tends to move flaps 20 and 40 toward their closed position. According to alternative embodiments, the top portion may be made substantially flat so that a biasing force is not created when the flaps are opened.

Figure 3B:
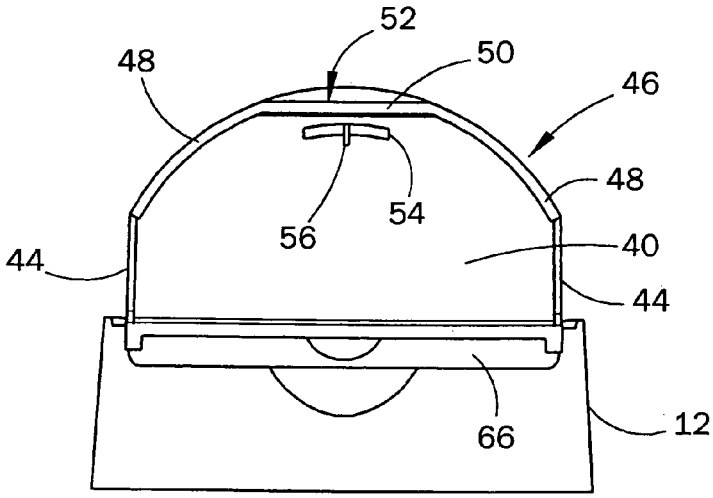
FIG. 3B is a front view of a closure for a container having with a spooning flap in an open position according to a preferred embodiment.

Spooning flap 40 similarly encloses spooning opening 42. According to a preferred embodiment, spooning flap 40 has a projection (shown schematically as a downwardly extending front skirt 46) depending from a lower surface of spooning flap 40 that includes an arcuate portion 48 and a substantially straight portion 50 (as shown schematically in FIGS. 3B and 5A). Arcuate portion 48 preferably extends through an arc having an angle of between approximately one-hundred twenty (120) and one-hundred eighty (180) degrees to provide a sufficiently large spooning opening and defines an outer substantially vertical surface of closure 10 when spooning flap 40 is in a closed position. Front skirt 46 has an indentation 52 disposed at a central outer portion of front skirt 46 coincident with straight portion 50, which may facilitate the opening of the flap by a user. Front skirt 46 preferably extends around closure 10 when in the closed position for an angle of between approximately one-hundred (100) and one-hundred fifty (150) degrees. Front skirt 46 forms between one-hundred (100) and one-hundred fifty (150) degrees of the circumference of the upper part of closure 10. As with front skirt 26 of shaker flap 20, since front skirt 46 is generally arcuate (rather than uniformly straight) it has greater structural strength and it is less likely to be bent over when its flap is grasped and opened, and further distributes the grasping load more evenly around the outer edge of spooning flap 40. Accordingly, spooning flap 40 may require less plastic when manufactured.

Referring further to FIGS. 1A and 1B, a recess 64 is provided in the cylindrical portion 12 of closure 10 to receive front skirt 26 of shaker flap 20, according to a preferred embodiment. By providing recess 64, front skirt 26 can be set into an outer surface of closure 10 when shaker flap 20 is closed, thereby reducing the risk that front skirt 26 will be inadvertently caught and shaker flap 20 opened and the contents of the container spilled. Similarly, a recess 66 is provided in closure 10 on the opposite side of closure 10 from recess 64 to similarly receive front skirt 46 of spooning flap 40 for the same reason. The recess of front skirts 26 and 46 provides a smooth and contiguous part of the cylindrical portion 12 of closure 10.

Figure 4B:
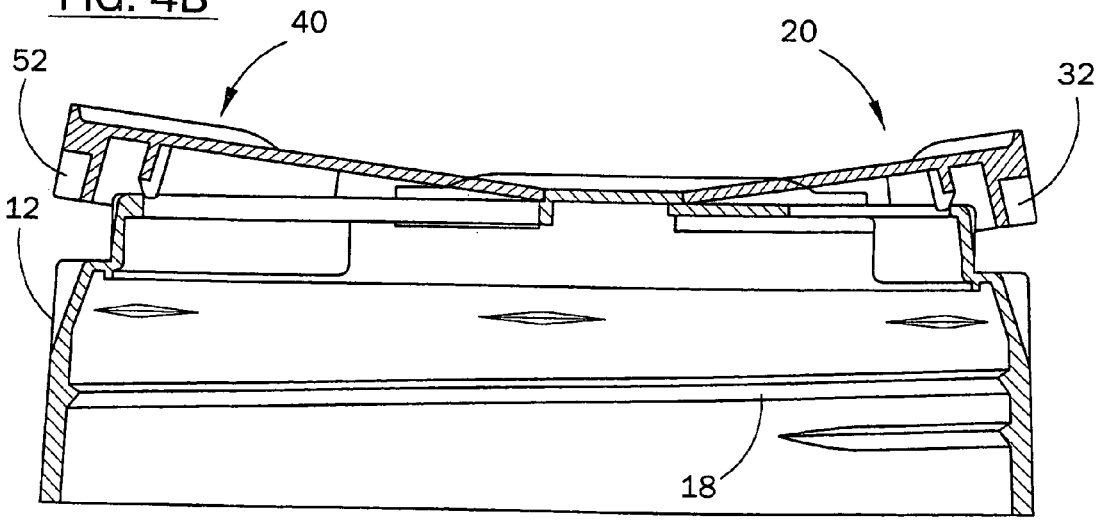
FIG. 4B is a cross sectional view of the closure for a container of FIG. 4A with a spooning flap and a shaker flap approaching a closed position according to a preferred embodiment.
Figure 4C:
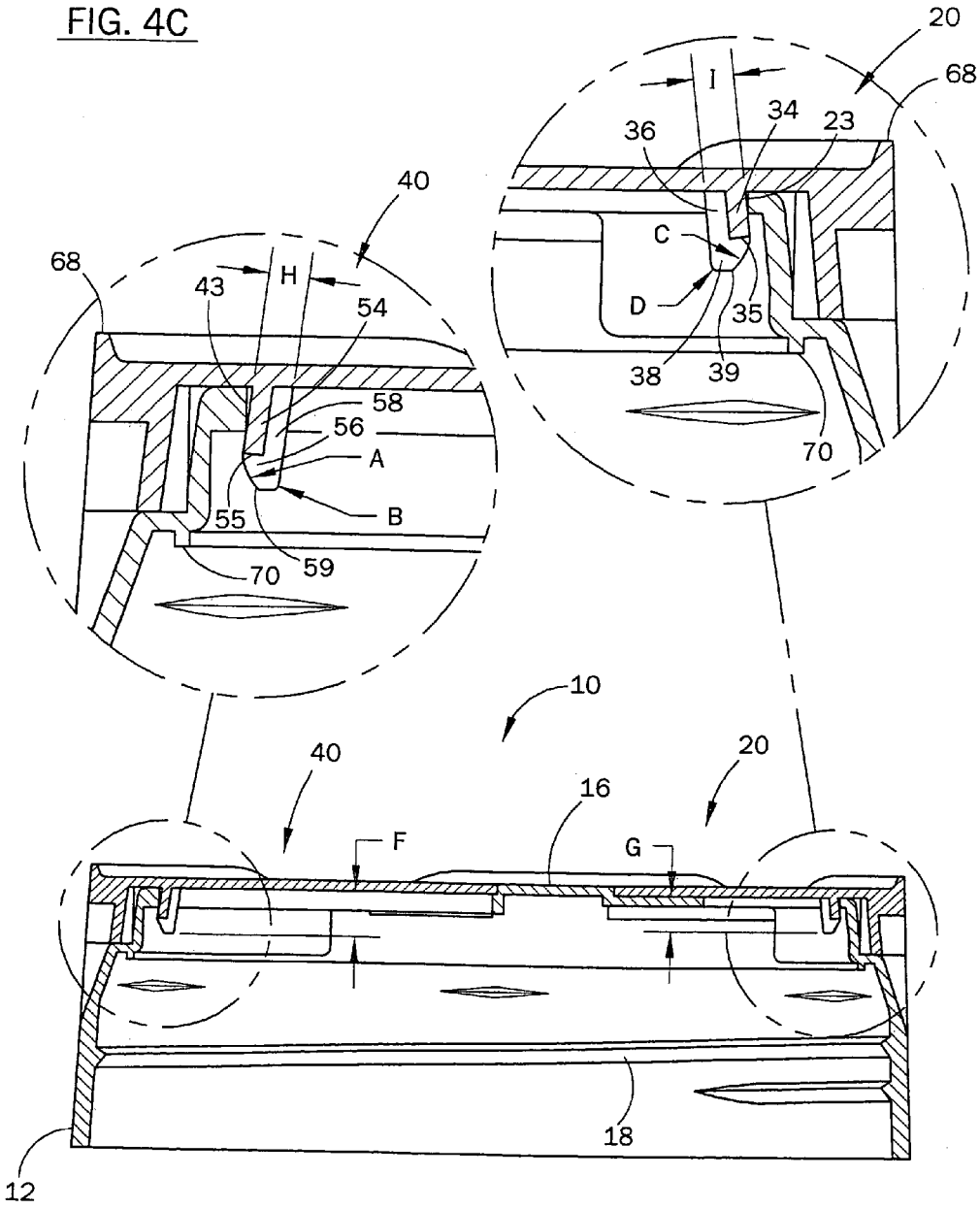
FIG. 4C is a cross sectional view along line 4C—4C of FIG. 2A of a closure for a container with a spooning flap and a shaker flap in a closed position according to a preferred embodiment.

Referring to FIGS. 4A–4C, a rim (shown schematically as a lip 68, or trim portion, etc.) is provided to facilitate the arrangement of multiple containers in a stacked relationship. Lip 68 extends substantially around the perimeter of top portion 14 but may have interruptions at suitable locations for improving aesthetics or flap operability. As shown in FIG. 4C, lip 68 is formed with a cross section in the shape of an upwardly projecting, truncated right triangle, but may be formed having an inwardly concave or wedge-shaped profile for improved molding releasability in alternative embodiments. According to a preferred embodiment, an underside of top portion 14 has an annular sealing rim, mouth or land 70 projecting downwardly and extending continuously adjacent an inner perimeter of cylindrical portion 12. Land 70 is laterally positioned to facilitate an abutting relationship with the mouth of a corresponding container (not shown).

Referring to FIG. 1A, a plurality of shaker openings 22 (shown schematically as circular apertures, but may have any suitable shape for dispensing material in a container) are provided to allow the contents within the container to be dispensed when shaker flap 20 is opened. In a preferred embodiment, these openings are arranged along an arc, but may be arranged in other patterns (e.g. straight line, matrix array, circular, etc.) suitable for dispensing the contents in a shaking operation in alternative embodiments.

Referring to FIGS. 1A and 4C, the closure 10 is shown with an interface for retaining, securing or latching the shaker flap according to a preferred embodiment. One or more interfaces such as projections, retainers, latches, extensions or skirts (shown schematically as downwardly latching tabs 34) are provided on an underside of shaker flap 20. Tabs 34 preferably have an arcuate shape that corresponds to the arcuate shape of shaker aperture 22 and extends from the underside of shaker flap 20 at an angle of between approximately nine (9) and twenty-five (25) degrees with respect to top portion 14. In a particularly preferred embodiment, tabs 34 extend from an underside of shaker flap 20 at an angle of between approximately fifteen (15) and twenty (20) degrees, with respect to top portion 14. The closure 10, including the flaps 20, tabs 34 and member 36 may be integrally molded as a single piece. In alternative embodiments, other angles of formation may be used and the closure may be made in one or several molding operations. In further alternative embodiments, the interfaces may have (in plan view) a non-arcuate or straight profile for engaging a corresponding straight segment on the edge (not shown).

Referring to FIGS. 4A–4C, the tabs 34 are shown according to a preferred embodiment. Tabs 34 are located or positioned on the shaker flap with an upper front surface of tab 34 approaching, but not extending beyond, edge 23. A lower leading edge 35 of tab 34 extends beyond edge 23 of shaker opening 22 such that when shaker flap 20 approaches the closed position, the leading edge 35 of tab 34 extends beyond edge 23 in a manner that would not otherwise allow tab 34 to enter shaker opening 22 without wedging into edge 23 to permit shaker flap 20 to close.

Referring further to FIGS. 1A and 4C, the interface (shown schematically as tab 34) may include a member such as a reinforcing member, stiffener, rigidifier, brace, rib, etc. (shown schematically as guide 36). In a particularly preferred embodiment, guide 36 is oriented substantially perpendicular to tab 34 in a "T-shaped" configuration that is integrally formed with tab 34 and flap 20, and has a outward surface generally coincident to the outward surface of tab 34. However, the member may be separate from the interface or reconfigured in relation to the interface in alternative embodiments. As shown in FIG. 4C, guide 36 includes a guide surface shown schematically as lower portion 38 extending downwardly beyond leading edge 35 of tab 34, and having an outer curved face (shown schematically as cam 39). In a particularly preferred embodiment, the surface of cam 39 is defined by multiple radii to create a wedging interaction with edge 23 as shaker flap 20 is moved into the closed position. However, a single radius may be used in alternative embodiments.

In a preferred embodiment, as shaker flap 20 is moved to the closed position, cam 39 contacts the inside of edge 23 before leading edge 35 of tab 34 reaches top portion 14, and tab 34 passes through shaker opening 22' and becomes wedged against edge 23 of shaker opening 22 when shaker flap 20 is moved into the closed position. As the shaker flap 20 is moved into the closed position, cam 39 of lower portion 38 disengages from edge 23, as tab 34 remains engaged with (remains wedged against) edge 23. The increasing force necessary to permit flap closure may be accommodated by deflection or flexing of any one or more of the shaker flap 20, the shaker opening 22, the shaker hinge 33, the top portion 14, or the web 16. In a preferred embodiment, guide 36 stiffens or reinforces tab 34 when shaker flap 20 is in the closed position to provide additional resistance to flexing of tab 34.

In a particularly preferred embodiment, closure 10 is a seventy (70) millimeter closure and guide 36 is sized (shown schematically in FIG. 4C), having a depth dimension G of approximately 0.152 (0.142–0.162) inches and a width dimension I of approximately 0.118 (0.108–0.128) inches; however, other dimensions may be used as appropriate to provide a wedging action for improved retention during closure of the shaker flap. Cam 39 on guide portion 36 is preferably formed with a multi-radii surface (shown schematically in FIG. 4C) with a first radius C of approximately 0.100 (0.090–0.110) inches and a second radius D of approximately 0.040 (0.030–0.050) inches; however, other dimensions may be used as appropriate to accommodate closures for other size containers and to provide a cam operation and wedging action for improved retention during closure of the shaker flap. According to alternative embodiments, a cam portion may be formed on the interface without a member.

Figure 6A:
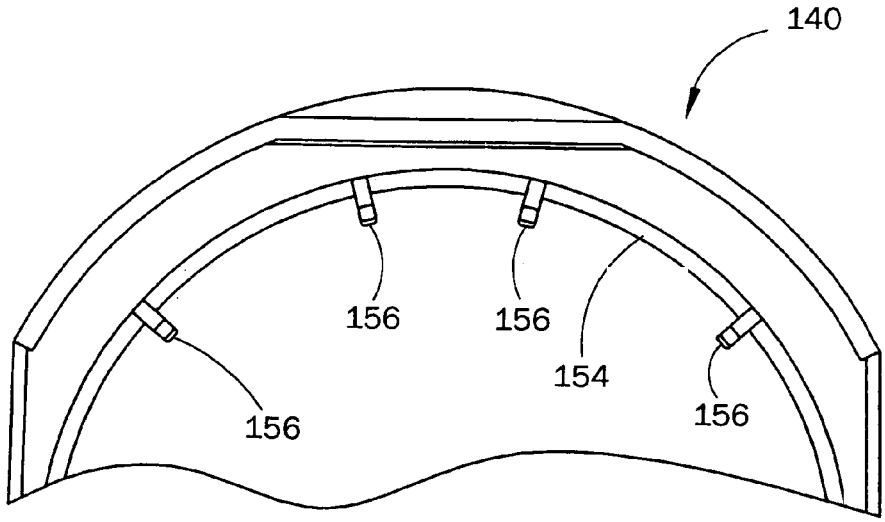
FIG. 6A is an elevation view of a spooning flap in an open position for a closure for a container according to an alternative embodiment.
Figure 6B:
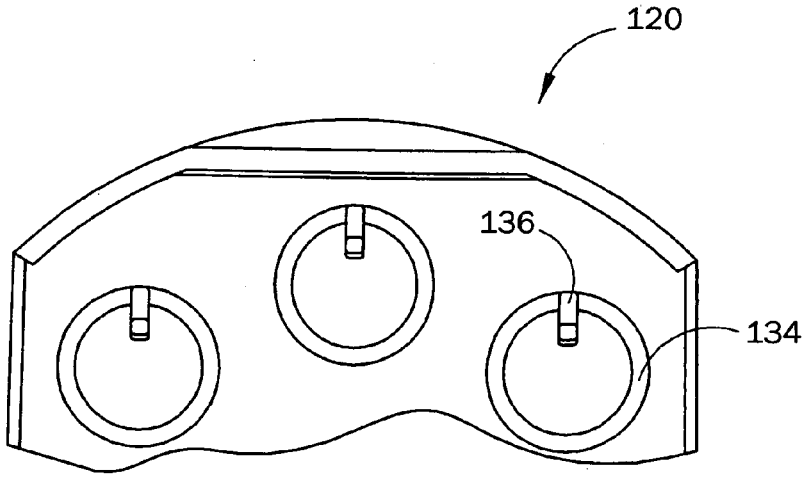
FIG. 6B is an elevation view of a shaker flap in an open position for a closure for a container according to an alternative embodiment.

Referring to FIG. 6B, an interface for latching a shaker flap is shown according to an alternative embodiment. Shaker flap 120 includes one or more shaker opening seals in the form of skirts or projections (shown schematically as downwardly extending circular tabs 134) from an underside of the shaker flap and having a profile (in plan view) corresponding to the shape of the shaker opening 22. Tabs 134 extend downward at an angle and include one or more members (shown schematically as guides 136) having the features shown in FIGS. 4A–4C as previously described.

Figure 7A:
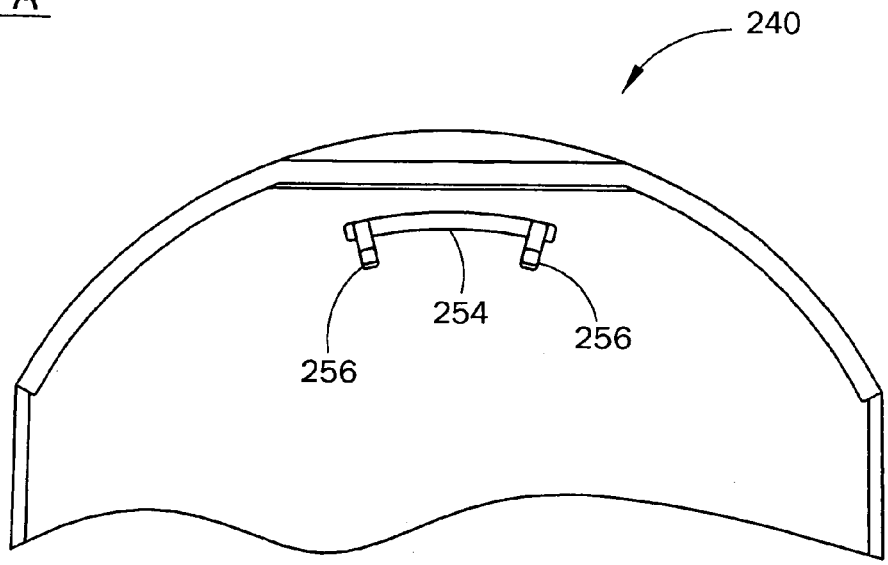
FIG. 7A is an elevation view of a spooning flap in an open position for a closure for a container according to an alternative embodiment.
Figure 7B:
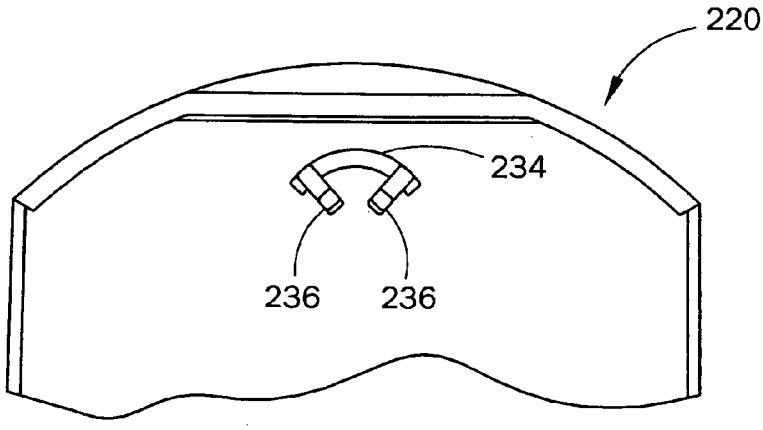
FIG. 7B is an elevation view of a shaker flap in an open position for a closure for a container according to an alternative embodiment.

Referring to FIG. 7B, an interface for latching a shaker flap is shown according to another alternative embodiment. Shaker flap 220 may include one or more projections (shown schematically as downwardly extending arcuate tabs 234) having a profile corresponding to the shape of a circular shaker opening 22. Tabs 234 extend at an angle and include two or more members (shown schematically as guides 236) having the features shown in FIGS. 4A–4C as previously described.

Referring to FIG. 2A, indicators for shaker flap 20 are shown according to an exemplary embodiment. Indicators 18 are formed or otherwise provided on an upper side of shaker flap 20 corresponding to the pattern of shaker openings 22 and permit identification of the shaker pattern without opening the shaker flap.

Referring to FIG. 1B, a spooning opening 42 (shown schematically as a truncated circular opening) is shown according to a preferred embodiment. Spooning opening 42 allows the contents within the container to be dispensed when spooning flap 40 is opened. One or more interfaces such as latches, retainers, projections, extensions or skirts (shown schematically as downwardly projecting tabs 54) are provided on an underside of spooning flap 40. As shown schematically in FIGS. 1B and 4C, tabs 54 have an arcuate shape that corresponds to the shape of spooning opening 42 and extend at an angle from the underside of spooning flap 40 of between approximately nine (9) and twenty-five (25) degrees with respect to top portion 14. In a particularly preferred embodiment, tabs 54 extend from an underside of spooning flap 40 at an angle of between approximately fifteen (15) and twenty (20) degrees, with respect to top portion 14. The closure 10, including the flap 40, tab 54 and guide 56 may be integrally molded as a single piece. In alternative embodiments, other angles of formation may be used and the closure may be made in one or several molding operations. In further alternative embodiments, the interfaces may have (in plan view) a non-arcuate or straight profile for engaging a corresponding straight segment on the edge (not shown).

Referring to FIGS. 4A–4C, tabs 54 are shown according to a preferred embodiment. Tabs 54 are located or positioned on the spooning flap with an upper front surface of tab 54 approaching, but not extending beyond, edge 43. A lower leading edge 55 of tab 54 extends beyond edge 43 such that when spooning flap 40 approaches the closed position, the leading edge 55 of tab 54 extends beyond edge 43 in a manner that would not otherwise allow tab 54 to enter spooning opening 42 without wedging into edge 43 to permit spooning flap 40 to close.

Referring further to FIGS. 1B and 4C, the interface (shown schematically as tab 54) may include a member such as a reinforcing member, stiffener, rigidifier, brace, rib, etc. (shown schematically as guide 56). In a particularly preferred embodiment, guide 56 is oriented substantially perpendicular to tab 54, in a "T-shaped" configuration that is integrally formed with tab 54 and flap 40, and has a outward surface generally coincident to the outward surface of tab 54. However, the member may be separate from the interface or reconfigured in relation to the interface in alternative embodiments. As shown in FIG. 4C, guide 56 includes a guide surface shown schematically as lower portion 58 extending downwardly beyond leading edge 55 of tab 54, and having an outer curved face (shown schematically as cam 59). In a particularly preferred embodiment, the surface of cam 59 is defined by multiple radii to create a wedging interaction with edge 43 as spooning flap 40 is moved into the closed position. However, a single radius may be used in alternative embodiments.

In a preferred embodiment, as spooning flap 40 is moved to the closed position, cam 59 contacts the inside of edge 43 before leading edge 55 of tab 54 reaches top portion 14, and tab 54 passes through spooning opening 42 and becomes wedged against edge 43 of spooning opening 42 when spooning flap 40 is moved into the closed position. As spooning flap 40 is moved into the closed position, cam 59 of lower portion 58 disengages from edge 43, while tab 54 remains engaged with (remains wedged against) edge 43. The increasing force necessary to permit flap closure may be resiliently accommodated by deflection or flexing of any one or more of the spooning flap 40, the spooning opening 42, the spooning hinge 53, the top portion 14, and the web 16. In a preferred embodiment, guide 56 stiffens or reinforces tab 54 when spooning flap 40 is in the closed position to provide additional resistance to flexing of tab 54.

In a particularly preferred embodiment, closure 10 is a seventy (70) millimeter closure and guide 56 is sized (shown schematically in FIG. 4C), having a depth dimension F of approximately 0.180 (0.170–0.190) inches and a width dimension H of approximately 0.115 (0.105–0.125) inches; however, other dimensions may be used as appropriate to provide a wedging action for improved retention during closure of the spooning flap. Cam 59 on guide portion 56 is preferably formed with a multi-radii surface (shown schematically in FIG. 4C) with a first radius A of approximately 0.100 (0.090–0.110) inches and a second radius B of approximately 0.040 (0.030–0.050) inches; however, other dimensions may be used as appropriate to accommodate closures for other size containers and to provide a cam operation and wedging action for improved retention during closure of the spooning flap. According to alternative embodiments, a cam portion may be formed on the tab portion without a member.

Referring to FIG. 6A, an interface for latching a spooning flap is shown according to an alternative embodiment. Spooning flap 140 includes a spooning opening seal in the form of a skirt or projection (shown schematically as downwardly extending truncated circular tab 154) from an underside of spooning flap 140 and having a profile (in plan view) corresponding to the shape of spooning opening 42. Tab 154 extends at an angle and includes one or more members (shown schematically as guides 156) having the features shown in FIGS. 4A–4C as previously described.

Referring to FIG. 7A, an interface for latching a spooning flap is shown according to another alternative embodiment. Spooning flap 240 includes one or more projections (shown schematically as downwardly extending arcuate tab 254) having a profile corresponding to the arcuate shape of spooning opening 42. Tabs 254 extend at an angle and include two or more members (shown schematically as guides 256) having the features shown in FIGS. 4A–4C as previously described.

Referring to FIG. 2A, indicators for spooning flap 40 are shown according to an exemplary embodiment. Indicator 19 is formed or otherwise provided on an upper side of spooning flap 40 to indicate the location of spooning opening 42 without opening spooning flap 40.

It is important to note that the construction and arrangement of the elements of the closure for a container provided herein are illustrative only. Although only a few exemplary embodiments of the present invention have been described in detail in this disclosure, those skilled in the art who review this disclosure will readily appreciate that many modifications are possible in these embodiments (such as variations in closure features such as orientation of flaps, skirts and corresponding recesses; variations in sizes, structures, shapes, dimensions and proportions of the tabs and stiffeners and other elements; flap hinge arrangements, configuration and operation of latching devices, arrangement of dispensing openings, use of materials, colors, combinations of shapes, etc.) without materially departing from the novel teachings and advantages of the invention. For example, the closure may be adapted and sized for use on any type of container or receptacle in a variety of sizes and for dispensing a variety of contents. According to other alternative embodiments, the closure may be adapted for installation to a container by a threaded interface or by a snap-on ring. Further, it is readily apparent that variations of the closure and its elements may be provided in a wide variety of shapes, sizes, and thicknesses. It is also readily apparent that the closure interfaces and members for latching the flaps may be designed with any profile and configuration suitable for securely latching the flaps to the closure body. For example, the tabs may be short arc portions with a member or members, or the interfaces may have an outline corresponding to the perimeter of the closure openings (not shown) with a member or multiple members, or other shapes useful for retaining the flaps securely to the closure body when the flaps are in a closed position. Accordingly, all such modifications are intended to be within the scope of the invention as defined in the appended claims.

The order or sequence of any process or method steps may be varied or resequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present inventions as expressed in the appended claims.

What is claimed is:

1. In an integrally-formed cover for a container comprising a cylindrical portion, a top portion having a shaker opening and a spooning opening, a shaker flap having an outer edge with a downwardly extending skirt and coupled to the top portion and configured for selective movement between an open position in which the shaker opening is opened and a closed position in which the shaker opening is covered by the shaker flap, a spooning flap having an outer edge with a downwardly extending skirt and coupled to the top portion and configured for selective movement between an open position in which the spooning opening is opened and a closed position in which the spooning opening is covered by the spooning flap, at least one projection extending from the shaker flap to releasably retain the shaker flap in the closed position, the improvement comprising:

the projection extending from the shaker flap comprises a tab; and a guide provided with the tab so that movement of the shaker flap from the open position to the closed position initially brings the guide into wedging interaction with an inner edge of the shaker opening and further movement of the shaker flap brings the tab into wedging interaction with the inner edge of the shaker opening;

so that the shaker flap is retained in the closed position by the wedging interaction of the tab against the inner edge of the shaker opening.

2. The cover of claim 1 wherein the shaker opening comprises a plurality of shaker openings and the guide is configured for wedging interaction with at least one of the plurality of shaker openings.

3. The cover of claim 1 further comprising an upwardly projecting lip extending substantially around an outer portion of the top portion, the shaker flap and the spooning flap, whereby the lip is configured to position a container bottom stacked on top of the cover.

4. The cover of claim 1 wherein the guide is provided at the center of the tab.

5. The cover of claim 1 wherein the guide includes a curved portion extending beyond a free end of the tab.

6. The cover of claim 5 wherein the curved portion of the guide is configured to contact the inner edge of the shaker opening.

7. The cover of claim 6 wherein the curved portion of the guide is provided on the outer surface of the guide.

8. The cover of claim 7 wherein the curved portion of the guide comprises a cam portion.

9. The cover of claim 8 wherein the cam portion is defined by at least one radius.

10. The cover of claim 1 wherein the tab extends angularly downward from an underside of the shaker flap and at least partially through the shaker opening when the shaker flap is in the closed position.

11. In a closure for a container comprising a base having at least one opening for dispensing a material from the container, a cover coupled atop the base having at least one flap movable between an open position for dispensing the material and a closed position for covering the opening, at least one projection extending from the flap to releasably retain the flap in the closed position, the improvement comprising:

a guide extending from the projection; and a guide surface provided on the guide and configured to contact an edge of the opening when the flap is moved toward the closed position and configured to create a wedging interaction with the edge of the opening when the flap is moved further toward the closed position;

so that the flap is retained in the closed position by the wedging interaction of the projection and the edge.

12. The closure of claim 11 wherein the cover and the base are integrally molded as a single piece.

13. The closure of claim 11 wherein the opening comprises a shaker opening and a spooning opening and the flap comprises a shaker flap and a spooning flap.

14. The closure of claim 13 wherein the shaker flap and the spooning flap are integrally molded as a single piece with the cover.

15. The closure of claim 13 further comprising an upwardly projecting lip extending at least partially around an outer portion of the cover, the shaker flap and the spooning flap, whereby the lip is configured to position a container bottom stacked on top of the cover.

16. The closure of claim 11 wherein the guide surface comprises a curved surface defined by at least one radius.

17. The closure of claim 11 wherein the edge is an inner edge of the opening.

18. The closure of claim 11 wherein the wedging interaction is formed by movement of the guide surface relative to the edge.

19. The closure of claim 11 wherein the flap is retained in the closed position by friction between the projection and an edge of the opening.

20. The closure of claim 11 further comprising a plurality of guides and at least one guide surface on each guide.

21. The closure of claim 11 wherein the guide extends substantially perpendicularly from the projection.

22. The closure of claim 11 wherein the guide is a stiffener for the projection.

23. The closure of claim 11, wherein the projection comprises a tab;

the flap comprises a spooning flap;

the opening comprises a spooning opening; and the edge comprises an inner edge of the spooning opening; and wherein the tab and the inner edge do not fit in size or shape so that the spooning flap is retained in the closed position by the wedging interaction of the tab and the inner edge of the spooning opening.

24. The closure of claim 11, wherein the projection comprises a tab;

the flap comprises a spooning flap;

the opening comprises a spooning opening; and the edge comprises an inner edge of the spooning opening; and wherein the tab and the inner edge do not conform correctly in size or shape so that the spooning flap is retained in the closed position by the wedging interaction of the tab and the inner edge of the spooning opening.

25. In a closure for a container comprising a base including at least one opening for dispensing a material from the container, a top portion coupled to the base having at least one flap movable between an open position for dispensing the material and a closed position for covering the opening, a first projection extending from the flap to retain the flap in the closed position, the improvement comprising:

a second projection extending from the first projection; and a guide surface provided on the second projection and configured to contact a portion of the base adjacent the opening when the flap is moved toward the closed position and configured to create a wedging interaction with the portion of the base adjacent the opening when the flap is moved further toward the closed position;

so that the flap is retained in the closed position by the wedging interaction of at least one of the first projection and the second projection with the portion of the base adjacent the opening.

26. The closure of claim 25 wherein the first projection is a tab integrally molded as a single piece with the flap.

27. The closure of claim 25 wherein the second projection is a guide integrally molded as a single piece with at least one of the flap and the first projection.

28. The closure of claim 25 wherein the first projection and the second projection are configured in a T-shape.

29. The closure of claim 25 wherein the wedging interaction is created by movement of the guide surface relative to the portion of the base adjacent the opening.

30. The closure of claim 25 wherein the opening comprises a spooning opening and the flap comprises a spooning flap.

31. The closure of claim 25 wherein the opening comprises at least one shaker opening and the flap comprises a shaker flap.

32. The closure of claim 25 wherein the first projection is a tab extending angularly downward from an underside of the flap.

33. The closure of claim 25 wherein the second projection is a guide configured to stiffen the first projection.

34. The closure of claim 25 wherein the guide surface is a curved surface that extends at least partially through the opening when the flap is in the closed position.

35. In a closure for a container comprising a base including at least one opening for dispensing a material from the container, a top portion coupled to the base having at least one flap movable about a hinge between an open position for dispensing the material and a closed position for covering the opening, the improvement comprising:

a first recess and a second recess formed in the base;

a first projection extending from a first side of the flap and configured to fit at least partially within the first recess when the flap is in the closed position; and a second projection extending from a second side of the flap and configured to fit at least partially within the second recess when the flap is in the closed position;

a third projection extending from the flap, the third projection being configured to engage an edge of the opening when the flap is in the closed position and to releasably retain the flap in the closed position;

wherein the first recess and the second recess each include a closed bottom portion to prevent any material from passing through the first recess and the second recess.

36. The closure of claim 35 wherein the first recess and the second recess are substantially perpendicular to the hinge.

37. The closure of claim 35 wherein the first projection comprises a side skirt extending downward from the first side of the flap.

38. The closure of claim 37 wherein the second projection comprises a side skirt extending downward from the second side of the flap opposite the first side of the flap.

39. The closure of claim 35 wherein the first recess and the first projection are substantially parallel to the second recess and the second projection.

40. The closure of claim 35 wherein the first projection and the second projection comprise a side wall extending downwardly from opposite sides of the flap.

41. The closure of claim 35 wherein the at least one flap comprises at least one of a shaker flap and a spooning flap.

42. The closure of claim 35 wherein the first recess, the second recess, the first projection and the second projection are substantially straight.

43. The closure of claim 35 further comprising a fourth projection extending downward from a free end of the flap opposite the hinge.

44. The closure of claim 43 wherein the first projection and the second projection are interconnected by the fourth projection.

45. The closure of claim 43, wherein the base comprises a third recess configured to receive the fourth projection of the flap when the flap is in the closed position.

46. The closure of claim 43, wherein the fourth projection comprises an indentation configured to receive a finger of a user.

47. The closure of claim 35, wherein the third projection comprises an interface.

48. The closure of claim 35, wherein the third projection comprises a first portion to releasably retain the flap in the closed position and a second portion to engage in a wedging interaction with the edge of the opening before the flap is fully closed.

49. The closure of claim 35, further comprising a raised lip extending upward from at least one of the flap and the top portion.

50. The closure of claim 35, wherein the base further comprises a second opening for dispensing material from the container and wherein the top portion further comprises a second flap movable about a hinge between an open position for dispensing the material and a closed position for covering the second opening.

51. The closure of claim 50, wherein the top portion includes a first portion that extends between a first side of the first flap and the second flap and a second portion that extends between a second side of the first flap and the second flap.

52. The closure of claim 51 further comprising a raised lip extending from the top portion.

53. The closure of claim 52, wherein the raised lip comprises a first segment extending from the first flap, a second segment extending from the second flap, a third segment extending from the first portion of the top portion, and a fourth segment extending from the second portion of the top portion.

54. The closure of claim 35, wherein the first recess and the second recess are channels.

55. The closure of claim 35, wherein the base comprises a rim having an inner edge defining the at least one opening in the base and wherein the third projection engages the inner edge of the rim when the flap is in the closed position to releasably retain the flap in the closed position.

56. The closure of claim 35, wherein the base and the top portion are integrally-formed as a single unitary body.

57. The closure of claim 35 further comprising an annular sealing member projecting downwardly from the top portion.

58. The closure of claim 35, wherein the third projection comprises a tab;

the at least one flap comprises a spooning flap;

the at least one opening comprises a spooning opening; and the edge of the opening comprises an inner edge of the spooning opening; and wherein the tab and the inner edge do not fit in size or shape so that the spooning flap is retained in the closed position by the wedging interaction of the tab and the inner edge of the spooning opening.

* * * * *